US006000697A

United States Patent [19]

Popadiuk et al.

[11] Patent Number: 6,000,697

[45] Date of Patent: Dec. 14, 1999

[54] DISPLAY FOR A PINBALL GAME

[75] Inventors: John A Popadiuk, Bartlett; John W. Skalon, Des Plaines, both of Ill.

[73] Assignee: Williams Electronics Games, Inc., Chicago, Ill.

[21] Appl. No.: 09/136,600

[22] Filed: Aug. 19, 1998

[51] Int. Cl.[6] ..... A63F 7/36

[52] U.S. Cl. ..... 273/118 R; 273/118 A

[58] Field of Search ..... 273/118, 119, 273/121

[56] References Cited

U.S. PATENT DOCUMENTS

| | | | |
|---|---|---|---|
| 4,323,241 | 4/1982 | Deutsch | 273/121 A |
| 4,367,876 | 1/1983 | Kotoyori . | |
| 4,375,286 | 3/1983 | Seitz et al. . | |
| 4,606,545 | 8/1986 | Ritchie . | |
| 4,840,375 | 6/1989 | Lawlor et al. . | |
| 4,971,324 | 11/1990 | Grabel et al. . | |
| 5,120,058 | 6/1992 | Trudeau et al. . | |
| 5,137,278 | 8/1992 | Schilling et al. . | |
| 5,149,093 | 9/1992 | Schilling et al. . | |
| 5,149,094 | 9/1992 | Tastad . | |
| 5,316,303 | 5/1994 | Trudeau et al. | 273/121 A |
| 5,632,482 | 5/1997 | Anghelo | 273/121 A X |
| 5,651,546 | 7/1997 | Lawlor et al. . | |
| 5,806,851 | 9/1998 | Gomez et al. | 273/121 A |

OTHER PUBLICATIONS

Article on 1989 game "Dakar" 3 pages.

Picture of 1989 game "World Cup '90" in Magazine entitled "Arcade Treasures"; p. 142.

Picture of 1982 "Baby Pac Man" in Magazine entitled "Arcade Treasures"; p. 116.

*Primary Examiner*—Raleigh W. Chiu

*Attorney, Agent, or Firm*—Arnold White & Durkee

[57] ABSTRACT

A pinball game comprises a cabinet, an inclined playfield, and a video display. The inclined playfield supports a rolling ball and a plurality of play features thereon. The cabinet includes a pair of opposing side walls and a rear wall extending between the opposing side walls. The playfield is housed within the cabinet such that the playfield is partially encompassed by the side walls and rear wall of the cabinet. An upper portion of the rear cabinet wall extends above a level of a rear portion of the playfield. The video display is mounted to this upper portion of the rear cabinet wall and is located in close proximity to the rear portion of the playfield. By mounting the display to the rear cabinet wall in close proximity to the playfield, the display can be easily viewed by a player during game play and, yet, allows the playfield to be easily serviced for maintenance and troubleshooting purposes without interference from the display. For maximum clarity of images shown on the display, the angle between a front surface of the display and an upper surface of the playfield is preferably such that the front surface of the display is generally perpendicular to a sight line extending between the display and a typical player.

19 Claims, 4 Drawing Sheets

DISPLAY FOR A PINBALL GAME

FIELD OF THE INVENTION

The present invention relates generally to pinball games and, more particularly, relates to a pinball game display located in close proximity to, but not fastened to, a rear portion of a pinball playfield so that the display can be easily viewed by a player during game play and, yet, allows the playfield to be easily serviced for maintenance and trouble-shooting purposes without interference from the display.

BACKGROUND OF THE INVENTION

Pinball games generally include an inclined playfield housed within a game cabinet and supporting a rolling ball (i.e., pinball). A generally vertical backbox extends upward from a rear portion of the game cabinet and houses both a video display and game control circuitry. A plurality of play features are arranged on the playfield. A game player uses a pair of mechanical flippers mounted at one end of the playfield to propel the rolling ball at the various play features on the playfield to score points and control the play of the game.

The video display generally shows player scores and provides special effects and suggestions to a player in response to certain events occurring on the playfield during game play. The special effects and suggestions on the display are intended to enhance the appeal of the pinball game. For example, the game control circuitry may cause the display to show an explosion in response to the rolling ball actuating a particular switch on the playfield. Switches are generally associated with the play features such that a play feature switch is actuated in response to the rolling ball impacting the associated play feature. The game control circuitry generally causes a sound generator to generate sounds consistent with the special effects and suggestions shown on the display.

A drawback of mounting the video display in the backbox is that the display is largely segregated from the playfield. Consequently, during game play, a player must divert his or her eyes away from events occurring on the playfield in order to view the scores, special effects, and suggestions provided by the display. Since keeping the rolling ball on the playfield and scoring points is generally of paramount concern to the player, the player may give minimal regard to the scores, special effects, and suggestions on the display. If the player misses some of the scores, special effects, and suggestions on the display due to its segregation from the playfield, the purpose of the display is defeated to some extent.

An alternative to mounting the display in the backbox is to mount the display in the rear center of the playfield, as shown in U.S. Pat. No. 4,375,286 to Seitz et al. Although the in-playfield display of Seitz can be viewed by a game player while also viewing events occurring on the playfield, the in-playfield display of Seitz somewhat interferes with the ability to easily service the playfield for maintenance and troubleshooting purposes. A service technician who wishes to gain full access to electrical and/or mechanical components beneath the playfield must first disconnect electrical wiring joining the display to a power supply beneath the playfield. Moreover, the display of Seitz faces a generally upward direction such that any images shown on the display may be obscured.

SUMMARY OF THE INVENTION

Accordingly, an object of the present invention is to provide a display for a pinball game that can be easily viewed by a player during game play and, yet, allows the playfield to be easily serviced for maintenance and trouble-shooting purposes without interference from the display.

This and other objects are realized by providing a pinball game including a cabinet, an inclined playfield, and a video display. The inclined playfield supports a rolling ball and a plurality of play features thereon. The cabinet includes a pair of opposing side walls and a rear wall extending between the opposing side walls. The playfield is housed within the cabinet such that the playfield is partially encompassed by the side walls and rear wall of the cabinet. An upper portion of the rear cabinet wall extends above a level of a rear portion of the playfield. The video display is mounted to this upper portion of the rear cabinet wall and is located in close proximity to the rear portion of the playfield. By mounting the display to the rear cabinet wall in close proximity to the playfield, the display can be easily viewed by a player during game play and, yet, allows the playfield to be easily serviced for maintenance and troubleshooting purposes without interference from the display.

For maximum clarity of images shown on the display, the angle between a front surface of the display and an upper surface of the playfield is preferably greater than 90 degrees but less than 135 degrees. By making the angle of the display relative to the playfield greater than 90 degrees, distracting reflections of the play features on the front surface of the display are minimized. By making the angle of the display relative to the playfield less than 135 degrees, the front surface of the display is nearly perpendicular to a sight line extending between the eyes of a typical game player and the display.

A generally vertical backbox preferably extends upward from a rear portion of the cabinet. Since, unlike most existing pinball games, the backbox is not used to house the video display, the backbox may use the space vacated by the display for additional game graphics, another display, or additional electrical or mechanical pinball game components.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
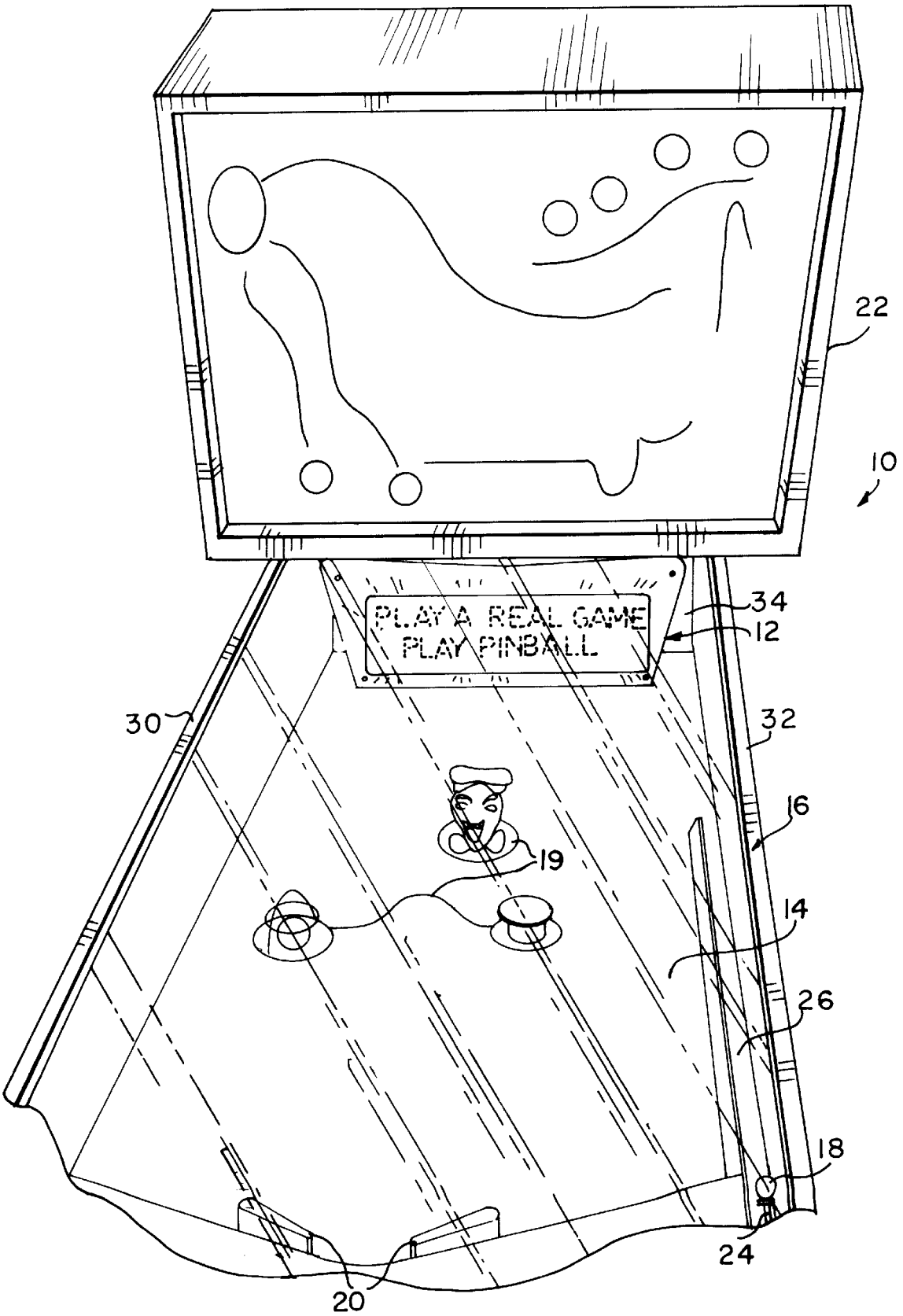
FIG. 1 is a perspective view of a pinball game including a video display assembly embodying the present invention.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 depicts a pinball game 10 including a video display assembly 12 embodying the present invention. The pinball game 10 includes an inclined playfield 14 housed within a game cabinet 16 and supporting a rolling ferromagnetic ball 18 and a plurality of play features 19 thereon. The rolling ball 18 can be propelled across the playfield 14 by a pair of player-operated flippers 20. A generally vertical backbox 22 extends upward from a rear portion of the cabinet 16 and houses a game controller and other electronics for controlling play of the game. Since, unlike most existing pinball games, the backbox 22 is not used to house the video display assembly 12, the backbox 22 may use the space vacated by the display for additional game graphics, another display, or additional electrical or mechanical pinball game components. A player manipulates a plunger 24 to shoot the rolling ball 18 up an alley 26 onto the playfield 14. When the rolling ball 18 approaches the flippers 20, the player presses flipper switches 28 (see FIG. 5) to activate the flippers 20 and thereby propel the rolling ball 18 toward the play features on the playfield 14. In practice, the playfield 14 incorporates a number of playfield features. FIG. 1 shows only a few of these play features 19 for clarity.

Figure 5:
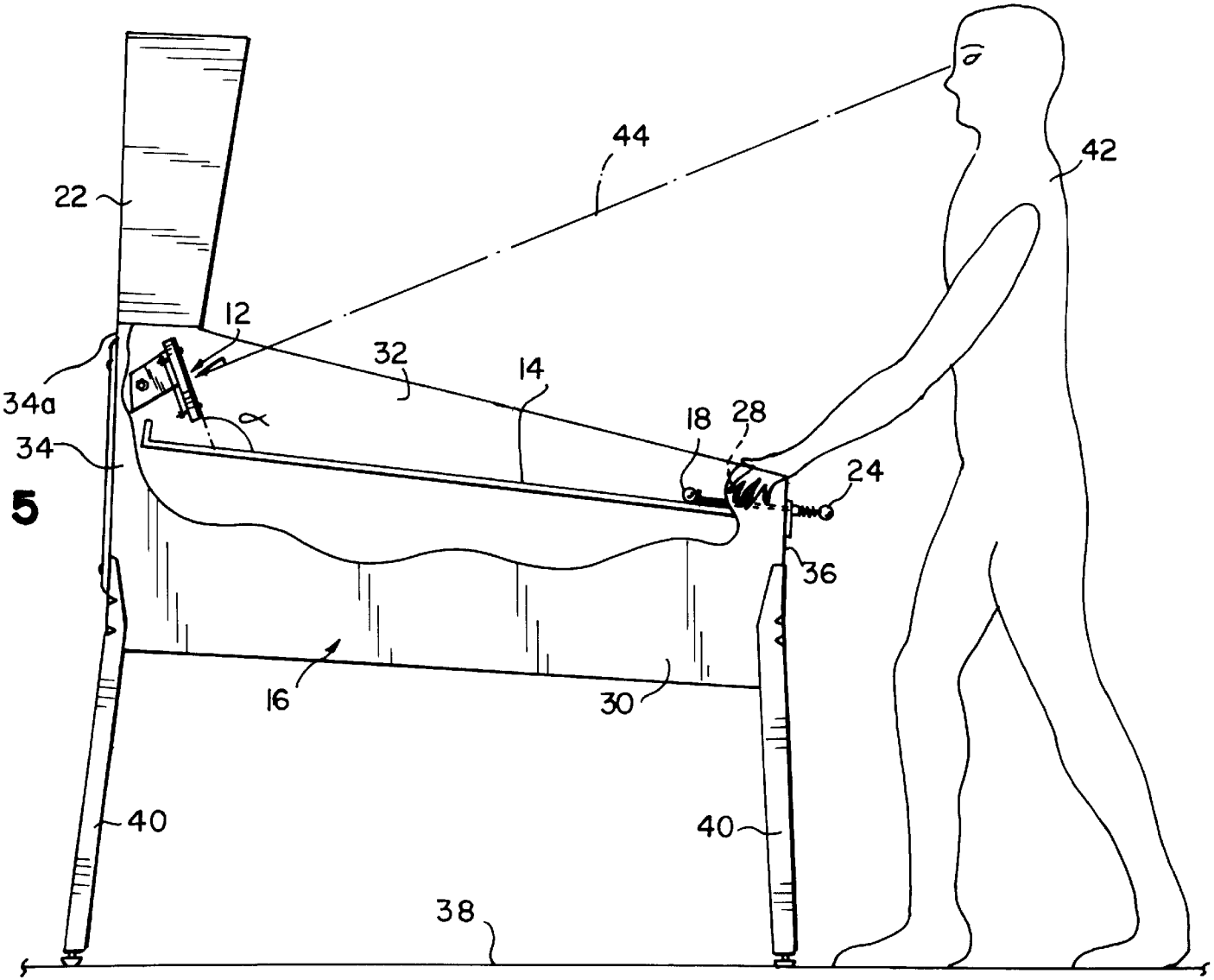
FIG. 5 is a side view of the pinball game of FIG. 1 with portions of a game cabinet removed to reveal the video display assembly and playfield housed therein.

Referring to FIGS. 1 and 5, the game cabinet 16 includes a pair of opposing side walls 30 and 32, a rear wall 34, and a front wall 36 opposing the rear wall 34. The rear and front walls 34 and 36 extend between the opposing side walls 30 and 32. The playfield 14 is housed within the cabinet 16 such that the playfield 14 is positioned below upper edges of the cabinet walls 30, 32, 34, and 36 and is encompassed by the cabinet walls. Consequently, upper portions of the cabinet walls extend above levels of respective adjacent portions of the playfield 14. For example, an upper portion 34*a* (FIG. 5) of the rear cabinet wall 34 extends above a level of an adjacent rear portion of the playfield 14. As best shown in FIG. 5, the cabinet 16 is elevated above a ground surface 38 by four corner legs 40 (only two legs shown) mounted to the respective four corners of the cabinet 16 and extending downward from the cabinet 16 to the ground surface 38.

Referring to FIG. 5, in accordance with the present invention, the video display assembly 12 has been strategically lowered from its conventional location in the vertical backbox 22 to a location just above the playfield 14 to provide for improved integration with game play. Specifically, the display assembly 12 is mounted to the upper portion 34*a* of the rear cabinet wall 34 and is located immediately above the rear portion of the playfield 14 such that the display assembly 12 appears to "float" over the playfield 14. By mounting the display assembly 12 to the rear cabinet wall 34 in close proximity to the playfield 14, the display assembly 12 can be easily viewed by a player 42 during game play and, yet, allows the playfield 14 to be easily serviced for maintenance and troubleshooting purposes without interference from the display assembly 12. The player 42 can view scores, special effects, and suggestions shown on the display assembly 12 without sacrificing the attention he or she must give to events occurring the playfield 14 in order to keep the rolling ball 18 in play.

Figure 6:
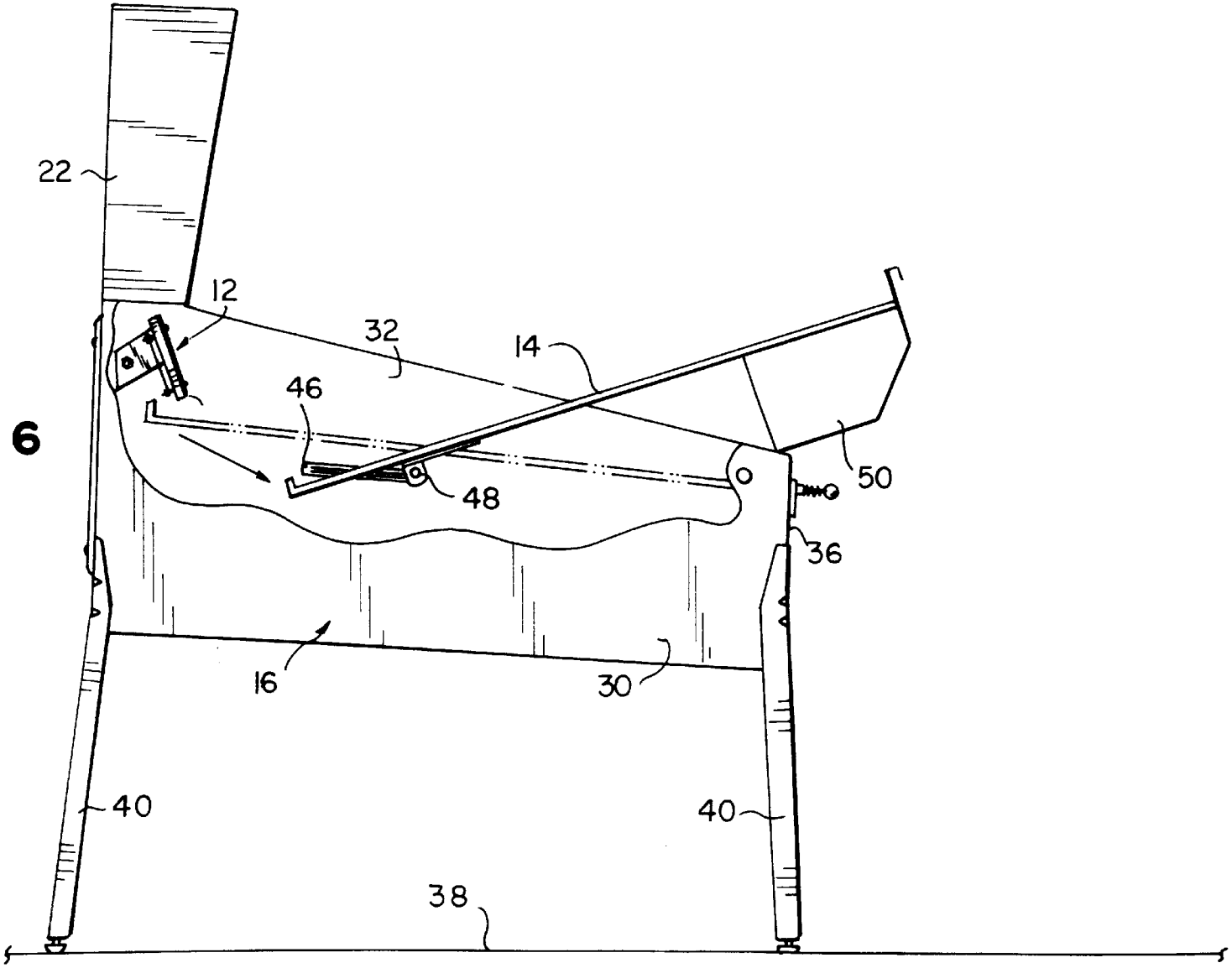
FIG. 6 is a side view of the pinball game of FIG. 1 showing the playfield slid away from the video display assembly and pivoted upward and partially removed from the game cabinet for servicing.

As shown in FIG. 6, to service the playfield 14, the playfield 14 may easily be removed from the cabinet 16 without interference from the display assembly 12. To facilitate removal of the playfield 14 from the cabinet 16, the playfield 14 is preferably mounted to the cabinet 16 using a mounting systems that allows the playfield 14 to be quickly slid and pivoted relative to the cabinet 16. Such a mounting system may, for example, include grooves 46 formed in the cabinet side walls 30 and 32 and spring-biased pivot pins 48 mounted on the playfield 14 for travel within the respective grooves 46. Guide bumpers 50, only one of which is shown in FIG. 6, are fastened to the underside of the playfield 14. The bumpers 50 prevent damage to game components that are attached to the underside of the playfield 14 by preventing contact between the components and the cabinet walls during movement of the playfield. Further details concerning the playfield mounting system may be obtained from U.S. Pat. No. 5,536,082 to Ritchie et al., which is incorporated herein by reference in its entirety.

Referring back to FIG. 5, for maximum clarity of images shown on the display assembly 12, the angle a between a front surface of the display assembly 12 and an upper surface of the playfield 14 is preferably greater than 90 degrees but less than 135 degrees. By making the angle of the display assembly 12 relative to the playfield 14 greater than 90 degrees, distracting reflections of the play features 19 (see FIG. 1) on the front surface of the display assembly 12 are minimized. By making the angle of the display assembly 12 relative to the playfield 14 less than 135 degrees, the front surface of the display assembly 12 is nearly perpendicular to a sight line 44 extending between the eyes of a typical game player 42 and the display assembly 12. In a preferred embodiment, the angle between the display assembly 12 and the playfield 14 is between about 100 degrees and about 125 degrees and is most preferably between about 110 degrees and about 120 degrees.

Figure 3:
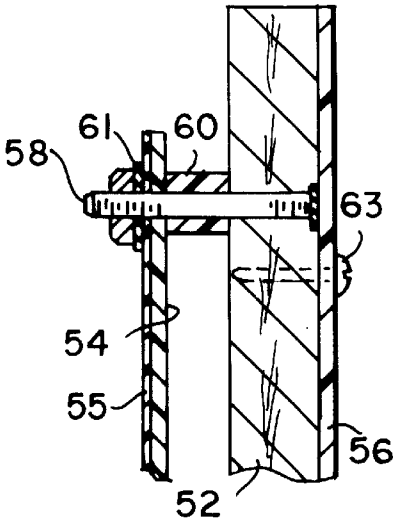
FIG. 3 is a sectional view taken generally along line 3—3 in FIG. 2.
Figure 4:
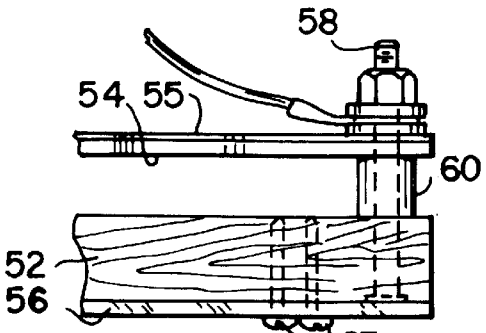
FIG. 4 is a sectional view taken generally along line 4—4 in FIG. 2.
Figure 2:
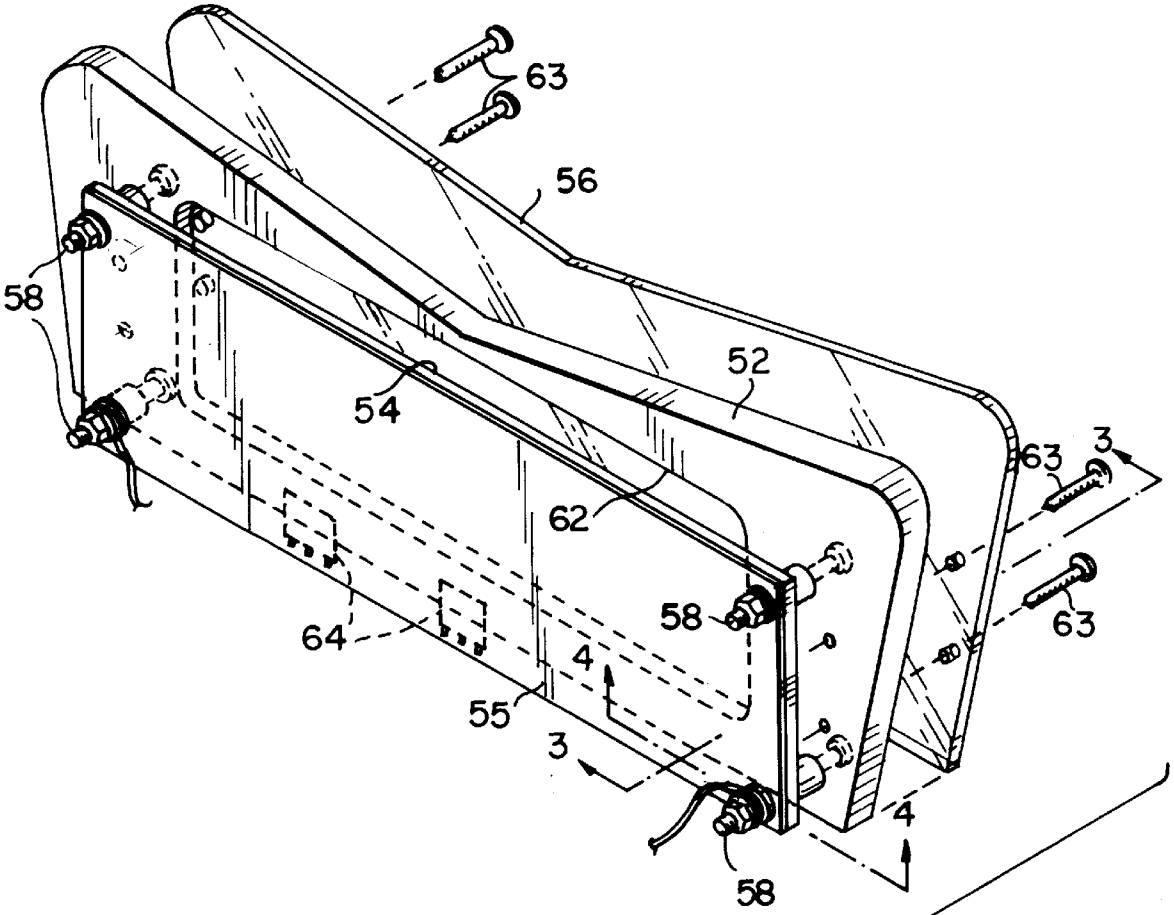
FIG. 2 is an isometric rear view of the video display assembly.

FIGS. 2, 3, and 4 illustrate the video display assembly 12 in greater detail. As shown in the isometric rear view in FIG. 2, the display assembly 12 includes a mounting frame 52, a video display 54, and a protective plastic cover 56. The display 54 is attached to the mounting frame 52 by a plurality of fasteners 58 in the form of screws, bolts, rivets, or the like. The fasteners 58 are inserted through respective aligned holes formed in the mounting frame 52 and the display 54. To maintain some separation between the mounting frame 52 and the display 54, spacers 60 (FIGS. 3 and 4) are telescopically mounted over the respective fasteners 58 and disposed between the mounting frame 52 and the display 54. A protective paper or plastic backing 55 is preferably applied to a rear surface of the display. As best shown in FIGS. 3 and 4, the display 54 and the backing 55 are secured adjacent to each other by virtue of the spacers 60 pressing against the display 54 on one side of the display/backing combination and fastener washers 61 pressing against the backing 55 on the other side. The protective plastic cover 56 is affixed to the mounting frame 52 by a plurality of fasteners 63 in the form of screws, bolts, rivets, or the like. The fasteners 63 are inserted through respective aligned holes formed in the cover 56 and the mounting frame 52.

The mounting frame 52 is preferably composed of wood or rigid plastic and includes a generally rectangular opening 62 through which a substantial portion of the display 54 may be seen by a player. To enhance the aesthetic appeal of the display assembly 12, the mounting frame 52 preferably includes artwork applied to its front surface and is shaped along its periphery. The peripheral shape and dimensions of the plastic cover 56 preferably correspond to the peripheral shape and dimensions of the mounting frame 52.

The display 54 is preferably a digital dot-matrix display. One such dot-matrix display is commercially available as model no. PD01-B220 (Plasmadot "Dot Matrix Gas Plasma" display) from Cherry Electrical Products Company of Waukegan, Ill. The display 54 includes on-board circuitry 64 electrically connected to a main power supply and to a game controller in the backbox 22 (see FIGS. 1 and 5). The game controller sends video signals to the circuitry 64 to control the digital graphics shown on display 54. The graphics may, for example, include player scores, special effects, and text.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A pinball game, comprising:

a cabinet including a pair of opposing side walls and a rear wall extending between said opposing side walls;

an inclined playfield supporting a rolling ball and a plurality of play features thereon, said playfield being housed within said cabinet such that said playfield is partially encompassed by said side walls and said rear wall of said cabinet, an upper portion of said rear cabinet wall extending above a level of a rear portion of said playfield; and a video display assembly mounted to said upper portion of said rear cabinet wall and overhanging said rear portion of said playfield, said video display assembly being tilted rearwardly relative to a vertical plane.

2. The pinball game of claim 1, wherein an angle between a front surface of said display assembly and an upper surface of said playfield is greater than 90 degrees and less than 135 degrees.

3. The pinball game of claim 2, wherein said angle between said front surface of said display assembly and said upper surface of said playfield is between about 110 degrees and about 120 degrees.

4. The pinball game of claim 1, wherein said display assembly includes a mounting frame and a display connected to each other, said mounting frame forming an opening through which said display is viewed by a player.

5. The pinball game of claim 4, wherein said display is separated from said mounting frame by spacers.

6. The pinball game of claim 4, further including a protective plastic sheet covering a front surface of said mounting frame.

7. The pinball game of claim 1, further including a backbox extending upward from a rear portion of said cabinet, said backbox being free of a video display therein.

8. The pinball game of claim 1, wherein said display assembly is located immediately above said rear portion of said playfield.

9. The pinball game of claim 1, wherein said display assembly includes a dot-matrix display.

10. The pinball game of claim 1, wherein said display assembly generally intersects and extends upwardly from said playfield.

11. A pinball game, comprising:

an inclined playfield supporting a rolling ball and a plurality of play features thereon;

a cabinet housing said playfield and including a pair of opposing side walls and a rear wall extending between said opposing side walls, an upper portion of said rear cabinet wall extending above a level of a rear portion of said playfield; and a tilted video display assembly mounted to said upper portion of said rear cabinet wall, said display assembly being located in front of said upper portion of said rear wall and overhanging said rear portion of said playfield.

12. The pinball game of claim 11, wherein an angle between a front surface of said display assembly and an upper surface of said playfield is between about 100 degrees and about 125 degrees.

13. The pinball game of claim 12, wherein said angle between said front surface of said display assembly and said upper surface of said playfield is between about 110 degrees and about 120 degrees.

14. The pinball game of claim 11, wherein said display assembly includes a mounting frame and a display connected to each other, said mounting frame forming an opening through which said display is viewed by a player.

15. The pinball game of claim 14, wherein said display is separated from said mounting frame by spacers.

16. The pinball game of claim 14, further including a protective plastic sheet covering a front surface of said mounting frame.

17. The pinball game of claim 11, further including a backbox extending upward from a rear portion of said cabinet, said backbox being free of a video display therein.

18. The pinball game of claim 11, wherein said display assembly includes a dot-matrix display.

19. The pinball game of claim 11, wherein said display assembly generally intersects and extends upwardly from said playfield.

* * * * *